US009671186B1

(12) United States Patent
Hoekema

(10) Patent No.: US 9,671,186 B1
(45) Date of Patent: Jun. 6, 2017

(54) SOFT PULL TRIGGER MECHANISM

(71) Applicant: Roy Hoekema, Wasilla, AK (US)

(72) Inventor: Roy Hoekema, Wasilla, AK (US)

( * ) Notice: Subject to any disclaimer, the term of this patent is extended or adjusted under 35 U.S.C. 154(b) by 0 days.

(21) Appl. No.: 15/062,565

(22) Filed: Mar. 7, 2016

Related U.S. Application Data

(60) Provisional application No. 62/198,858, filed on Jul. 30, 2015.

(51) Int. Cl.

| | |
|---|---|
| ***F41A 19/31*** | (2006.01) |
| ***F41A 19/17*** | (2006.01) |
| ***F41A 19/10*** | (2006.01) |
| ***F41A 17/56*** | (2006.01) |
| ***F41A 19/16*** | (2006.01) |

(52) U.S. Cl.
CPC ..... *F41A 19/17* (2013.01); *F41A 17/56* (2013.01); *F41A 19/10* (2013.01); *F41A 19/16* (2013.01); *F41A 19/31* (2013.01)

(58) Field of Classification Search
None
See application file for complete search history.

(56) References Cited

U.S. PATENT DOCUMENTS 2,249,231 A * 7/1941 Smith ..... F41A 19/16 42/69.02
3,950,876 A * 4/1976 Wild ..... F41A 19/32 42/69.01

FOREIGN PATENT DOCUMENTS

DE 2 253 199 * 5/1974 ..... F41C 19/02

* cited by examiner

*Primary Examiner* — Stephen M Johnson
(74) *Attorney, Agent, or Firm* — Michael J. Tavella

(57) ABSTRACT

A trigger mechanism that gives a shooter a durable, adjustable, soft and gentle pull. In this design, the sear block remains, but the trigger mechanism is replaced with a new, softer action mechanism. This mechanism uses a tripper that attaches to a trip. The trip is a formed body that has a lower frame and a top bearing that sits against the bottom of the seer. When the trigger is pulled, it rotates the tripper forward, which causes the trip to rotate backwards. The backward movement of the trip causes the top bearing to roll off the bottom of the seer, causing the gun to fire. The rotation of the trip is smooth compared to the snapping action of the seer in the prior art designs. This smooth movement does not jar the action, making for a better shot.

11 Claims, 12 Drawing Sheets

SOFT PULL TRIGGER MECHANISM

CROSS REFERENCE TO RELATED APPLICATIONS

This application claims benefit of Provisional application 62/198,858 filed Jul. 30, 2015.

STATEMENT REGARDING FEDERALLY SPONSORED RESEARCH AND DEVELOPMENT

Not Applicable

BACKGROUND OF THE INVENTION

1. Field of the Invention

This invention relates to trigger mechanisms and particularly to trigger mechanisms having a soft pull.

2. Description of the Prior Art

In competitive target shooting, accuracy is paramount. Competitors work to ensure that their guns are tuned as precisely as possible. However, despite all of the work done to improve the accuracy of the gun, the final aiming and execution of the shot is literally in the hands of the shooter. A conventional trigger, with a harder pull, can affect the accuracy of the gun simply in the act of firing it. For example, referring now to FIG. 1 a conventional trigger mechanism is shown as prior art. In this view, a trigger 100 is shown in the firing position (cocked). To fire the gun, the trigger 100 is shown rotating about a trigger pin 101. Note the arrows indicate a movement of the trigger 100 to the right, which causes the trigger to rotate so that the front of the trigger drops down, as indicated by the arrow. When the trigger 100 rotates, the claw 102 releases the sear block 103, which then rotates down around pin 104. The movement down (see arrow) drops the firing pin retainer 107, which releases the firing pin 105. When this occurs, the snapping action can jar the rifle just enough that the shooter loses accuracy in the shot. At high levels of competition, only a small movement of the rifle can result in lower scores.

BRIEF DESCRIPTION OF THE INVENTION

The instant invention overcomes this difficulty. Thus, the object of this invention is to provide a trigger mechanism that gives a shooter a durable, adjustable, soft and gentle pull for the improvement of rifle scores. It is also available with a side-to-side movement of the trigger as an option, if desired. In the instant invention, the sear block remains, but the trigger mechanism is replaced with a new, softer action mechanism. This mechanism uses a tripper that attaches to a trip. The trip is a formed body that has a lower frame and a top bearing that sits against the bottom of the sear. When the trigger is pulled, it rotates the tripper forward, which causes the trip to rotate backwards. The backward movement of the trip causes the top bearing to roll off the bottom of the sear, causing the gun to fire. The rotation of the trip is smooth compared to the snapping action of the ee sear in the prior art designs. This smooth movement does not jar the action, making for a better shot. Because this softer action mechanism is so sensitive, a safety mechanism is added to protect the users when preparing to fire.

BRIEF DESCRIPTION OF THE DRAWINGS

FIG. 10 is a detail view of the action, as mounted in a gun showing the trigger guard and the safety mechanism. In this view, the gun is cocked and the safety is on.

DETAILED DESCRIPTION OF THE INVENTION

My current invention is a soft trigger mechanism that allows a gentler pull to fire the gun, which can improve the accuracy of the shot. It does this by replacing the conventional trigger to produce a trigger action that is softer and allows a gentler pull when used with a conventional sear block. Note that the terms forward or rearward when used herein refer to the orientation of the gun action with respect to the rifle in which it is installed. The term forward refers to the front or barrel of the rifle and reward to the stock.

Figure 2:
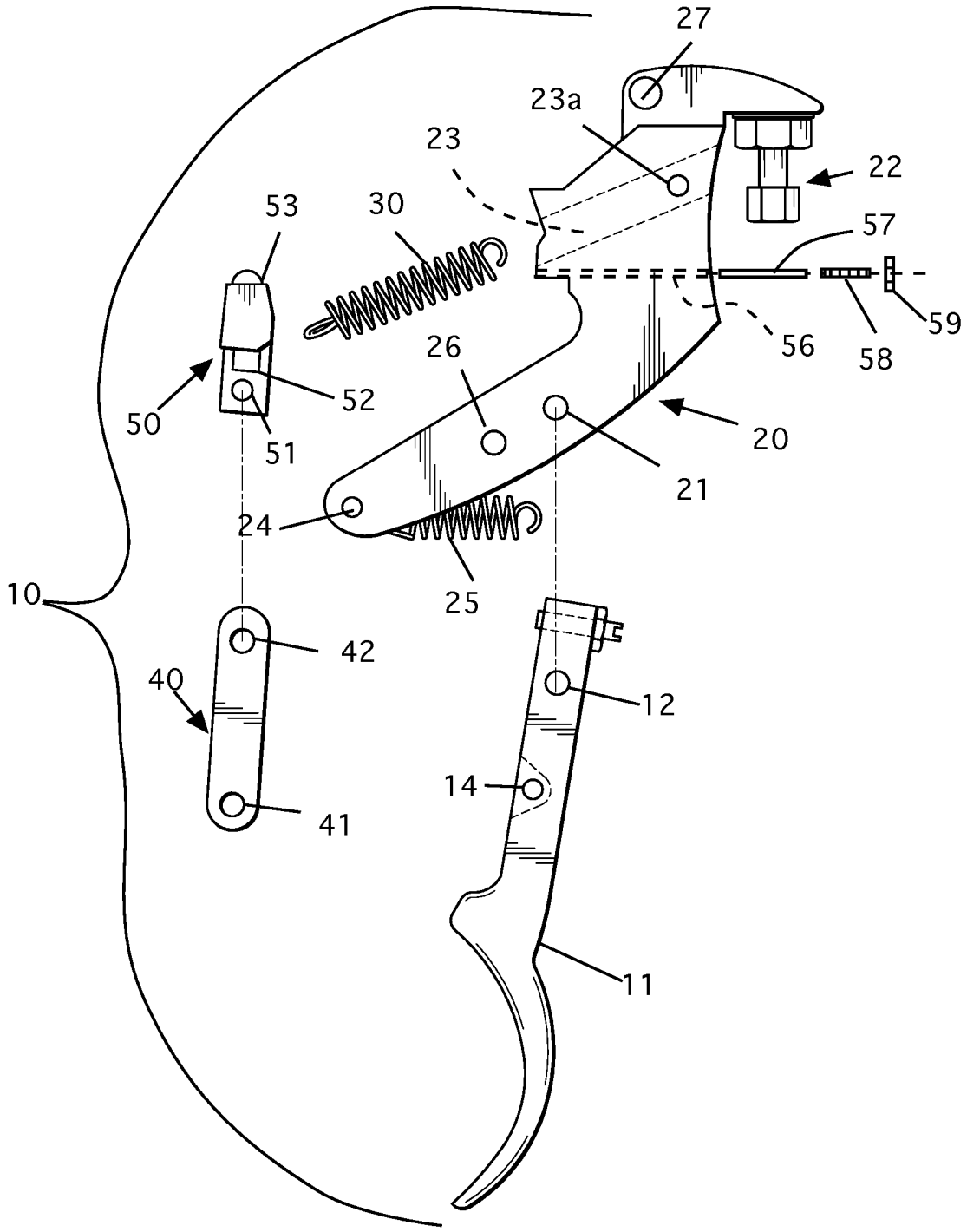
FIG. 2 is a detail parts view showing the parts of my new firing mechanism.

Referring now to the figures and particularly to FIG. 2 the parts of my new firing mechanism is shown. The parts of the new device 10 include a trigger 11 that is attached to encasement 20 at hole 12 in the trigger, which aligns with hole 21 in the encasement. Pin or other fastener 13 (see, FIG. 3, e. g.) holds the parts together, so the trigger can pivot on the encasement, as discussed below. The encasement has a screw and nut combination 22, located in the upper portion of the encasement, as shown, that is a down pressure adjustment. The encasement 20 also has a slot 23 formed in it, which has a pin 23*a* in it to hold the trip spring 30 (see e. g., FIG. 3). The encasement also has a pin 24 that holds the trigger return spring 25, which connects to the trigger at pin 14. Other components include the tripper 40, which has a hole 41 that attaches to the encasement at pin 26 and a hole 42 that attaches to the trip 50 at pin 51. The trip 50 is a formed body that has a lower frame 52 a top bearing 53. A trigger free play adjustment mechanism is also provided. This is installed in a channel 56 in the encasement below the trip spring 30, which receives a pin 57, a setscrew 58, and a lock nut 59.

Figure 3:
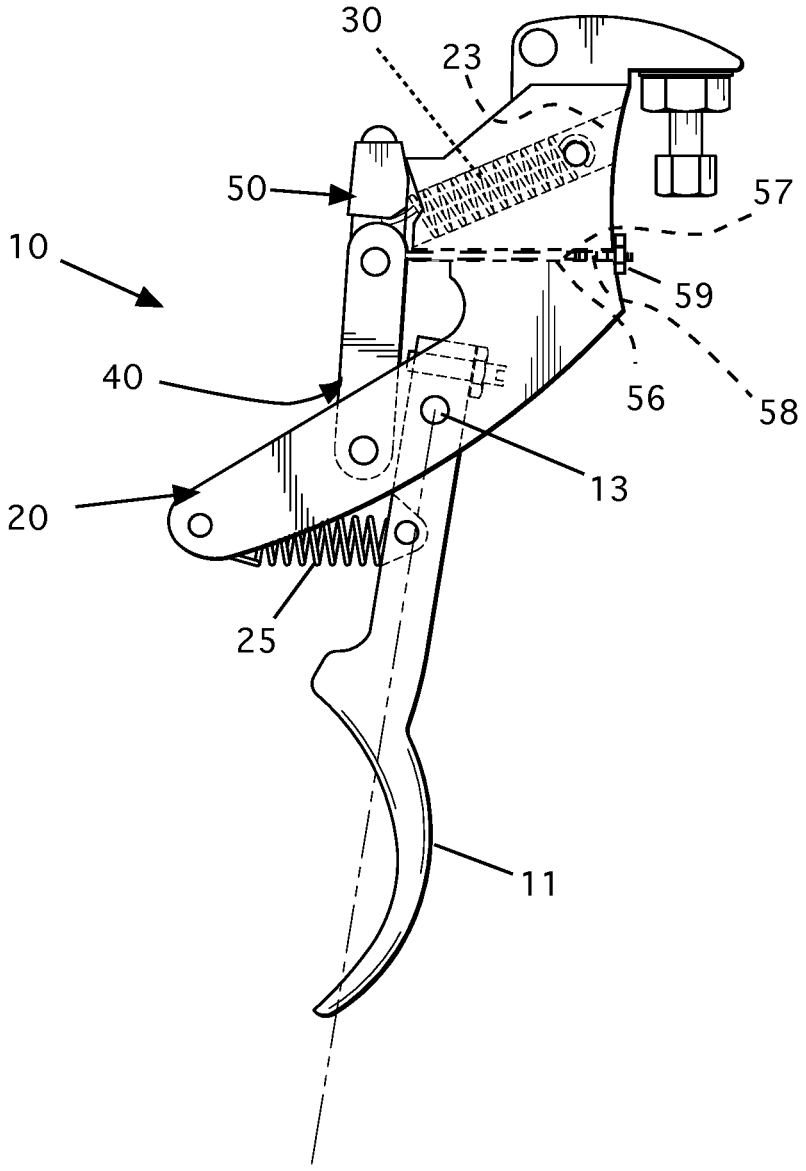
FIG. 3 is a detail view of the invention in the cocked position.
Figure 4:
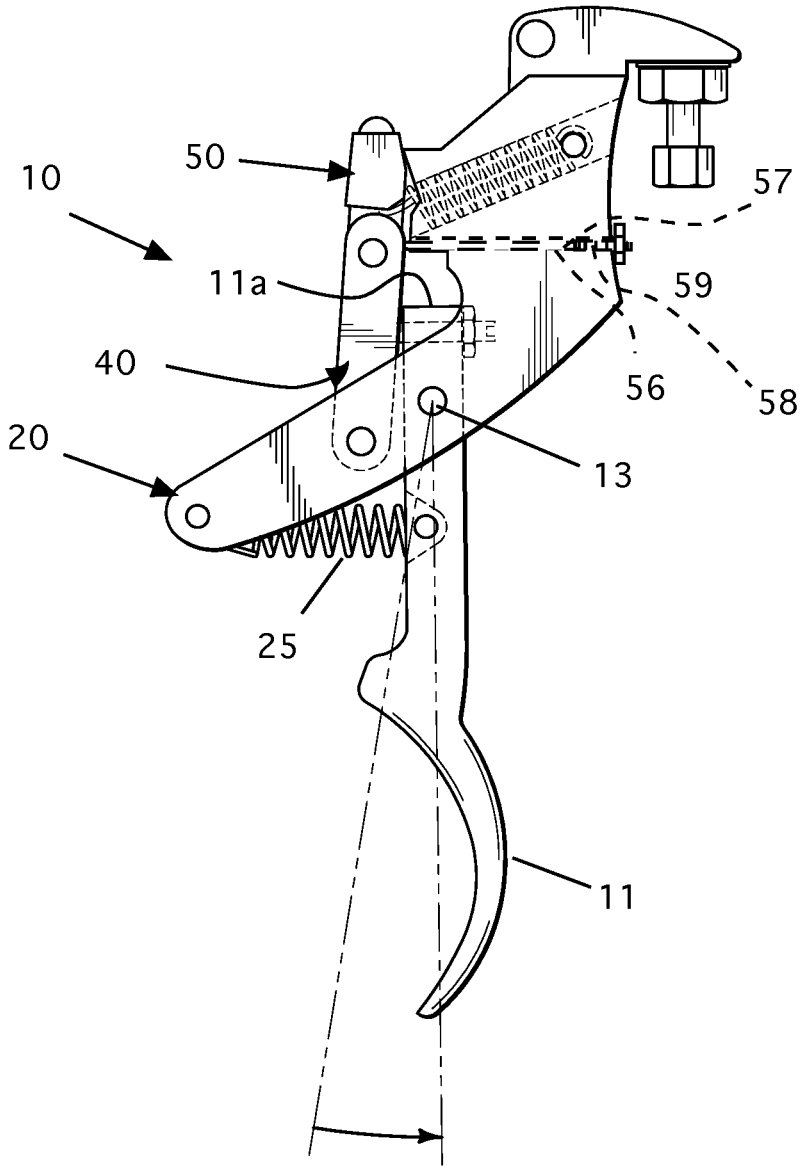
FIG. 4 is a detail view of the invention showing the trigger in mid-pull.
Figure 5:
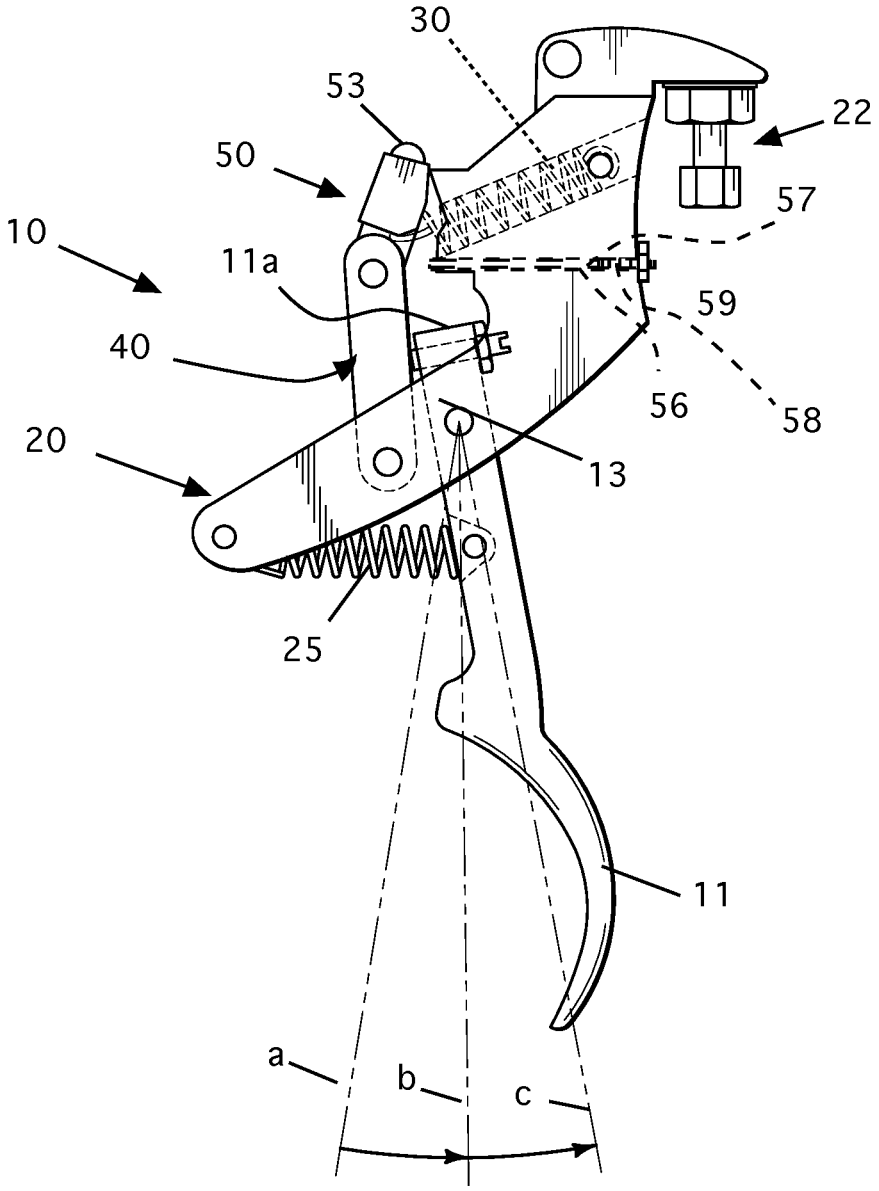
FIG. 5 a detail view of the invention after firing in an uncocked position.

FIGS. 3-5 show the action going from the cocked position to the fully uncocked (fired) position. FIG. 3 is a detail view of the invention in the cocked position. In this figure, the device 10 is shown fully assembled. As show, the trigger 11 is in a forward angle (as shown by the first dashed line a) with respect to the encasement 20. Note that the trip spring 30 is fully compressed with the slot 23. The tripper 40 is rearward against the encasement 20 and is in vertical alignment with the trip 50 as shown. The setscrew 58, and a lock nut 59 of the trigger free play adjustment mechanism are shown in place. This mechanism adjusts the sensitivity of the tripper by applying pressure on the tripper as shown. In practice, the setscrew is tightened down until the mechanism will not cock. Then, the setscrew is backed off until the gun can just be cocked. This is the most sensitive for the mechanism. In this position, only a minor movement of the trigger is enough to fire the gun. As discussed below, a safety mechanism is incorporated that allows the gun to be cocked in this most sensitive position and still be safe in that the trigger cannot be pulled. The FIGS. 3-5 do not show the safety mechanism, however.

FIG. 4 is a detail view of the invention showing the trigger in mid-pull. As the trigger 11 is pulled, it rotates rearward as shown in FIG. 4. Note the difference in position between the first dashed line a, and the second line b. Note too that the trigger return spring 25 is extended. Finally note that the top 11*a* of the trigger 11 is resting against the trip 40 and that, at this point, the tripper is still aligned with the trip 50.

FIG. 5 a detail view of the invention after firing in an uncocked position. In this picture, the gun has been fired. Note the position of the trigger 11 is in position c with respect to the other two positions (as indicated by the dashed lines a and b). Note that the trigger return spring 25 is fully extended. When the trigger has been fully pulled, the top of the trigger 11 pushes the trip 40 to the left, which causes the trip 50 to rotate to the right, as shown. The trip spring 30 is shown extended and is used to control the movement of the trip 50.

Figure 6:
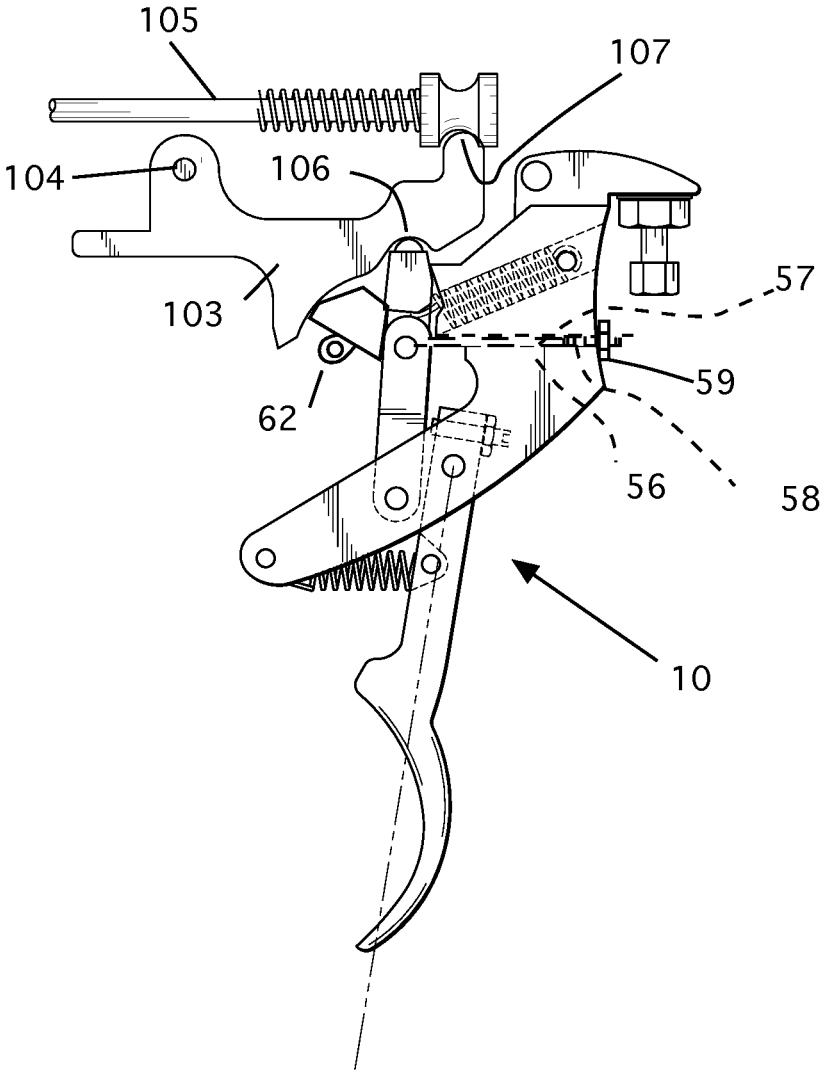
FIG. 6 is a detail view of the invention in the cocked position showing the invention in relation to Winchester type a sear block.
Figure 7:
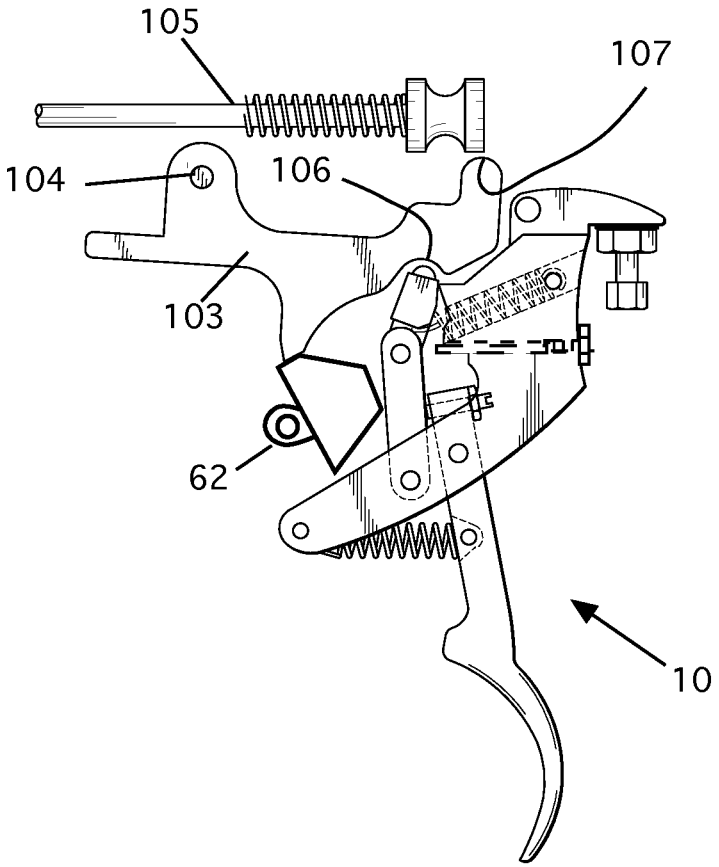
FIG. 7 a detail view of the invention after firing in an uncocked position showing the invention in relation to a Winchester type sear block.

FIGS. 6 and 7 show this action with the addition of a sear block and firing pin. In this way, the actual performance of the device is shown. FIG. 6 shows the position of the invention 10 with respect to a sear block 103 and a firing pin 105, when cocked. The invention is shown in the same position of FIG. 3. Note how the top bearing 53 of the trip 50 rests in a recess 106 of the sear block 103. This allows the sear block to remain in a horizontal position and to allow the firing pin retainer 107 to retain the firing pin 105. Note too that the blocking element 62 of the safety mechanism is also shown. In this position, the blocking element 62 is in the safe mode. In this position, the blocking element 62 is positioned between the tripper and the sear block. In this position, the trigger cannot be pulled and the tripper cannot be pushed to the left.

Figure 1:
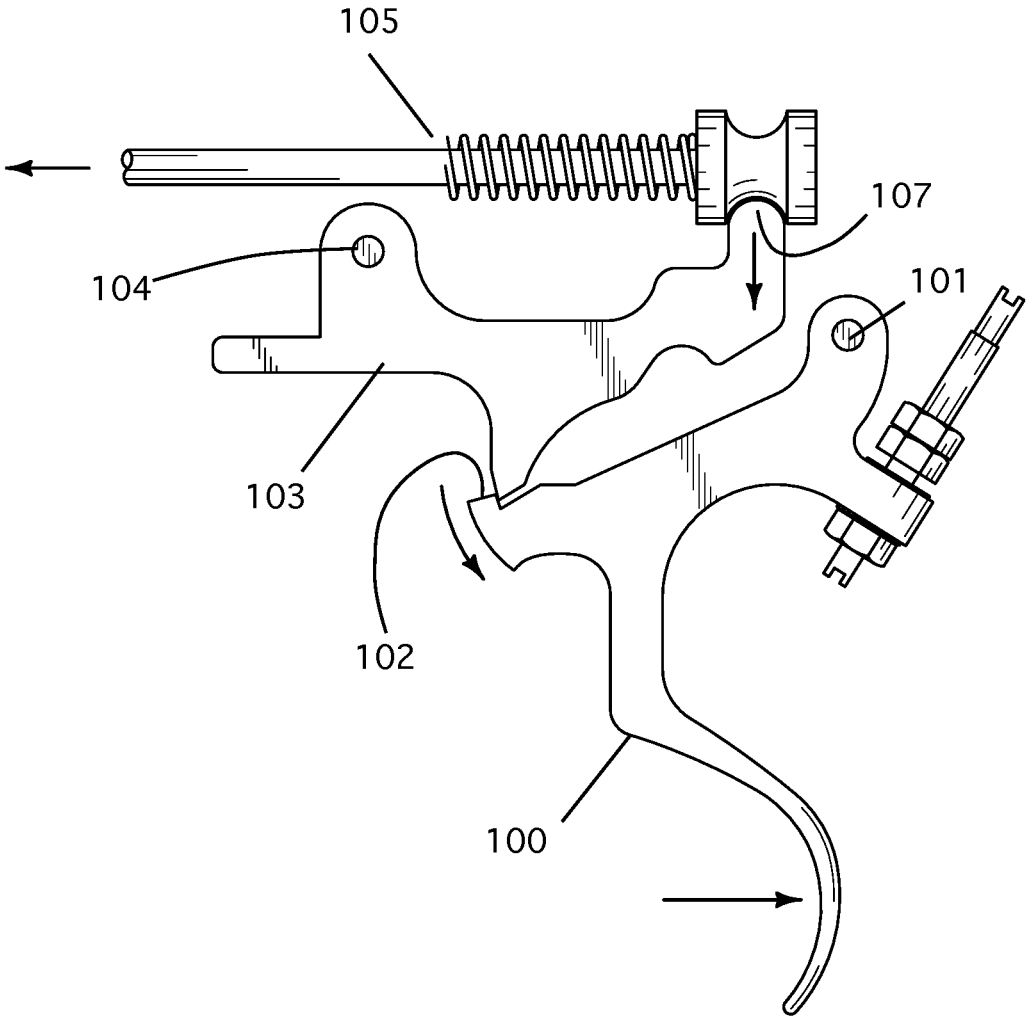
FIG. 1 Prior Art
FIG. 1 is a side detail view of a conventional trigger as prior art.

FIG. 7 shows the trigger 11 fully pulled as shown in FIG. 5. Note how the bearing 53 on the trip has rotated back, which allows the sear block 103 to drop slightly, rotating on pin 104. When the sear block drops, it releases the firing pin 105, which is shown moved forward. This causes the gun to be fired. Note the difference between this motion and that of the prior art as shown in FIG. 1. Instead of a snap when the sear block is released in FIG. 1, the invention produces a smoother action when firing. This reduces any jerking motion on firing and makes for a more certain shot. As before, this figure also shows the safety mechanism's blocking element 62 rotated into the safety off position. Here, the blocking element has moved and the trigger can be pulled and the gun fired.

Figure 8:
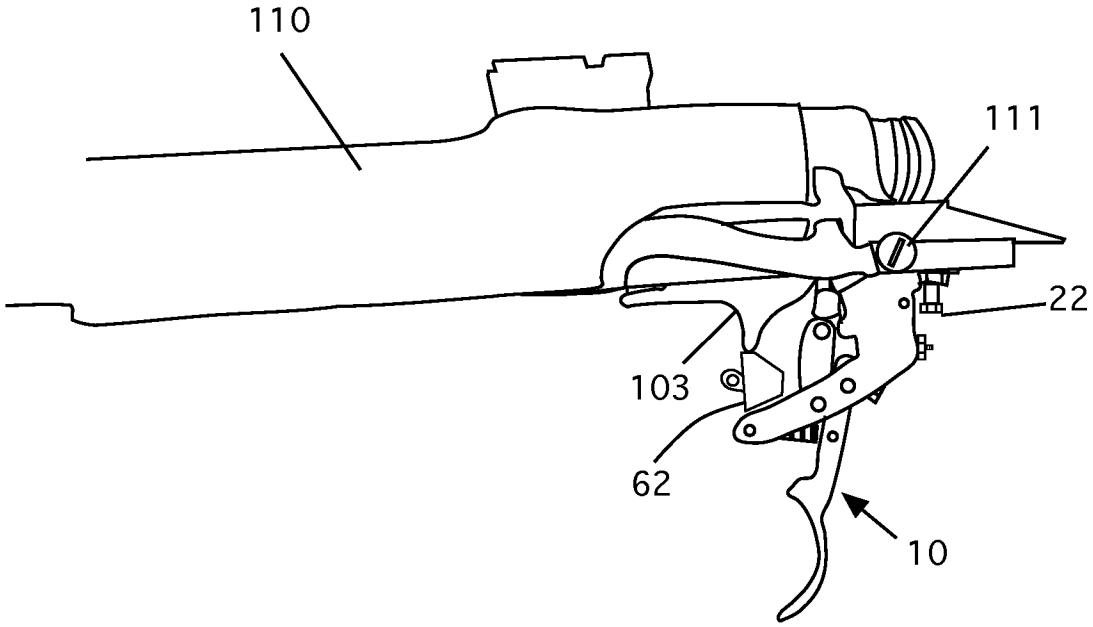
FIG. 8 is a detail view of the invention in the cocked position mounted in a rifle with the stock removed.

FIG. 8 is a detail view of the invention in the cocked position mounted in a rifle with the stock removed. Here, the rifle body 110 is shown with my new action in place. Note the sear block 103 is shown partially within the rifle. As noted above, it is held in place by pin "and by the bearing 53 on the trip. The action is secured in the rifle by a screw 111, which holds the encasement 20 at hole 27 (note the position of the down pressure adjustment screw 22. Note too, the position of the blocking element 62. Here, the gun is cocked but the safety is "off", so that the gun can be fired.

Figure 9:
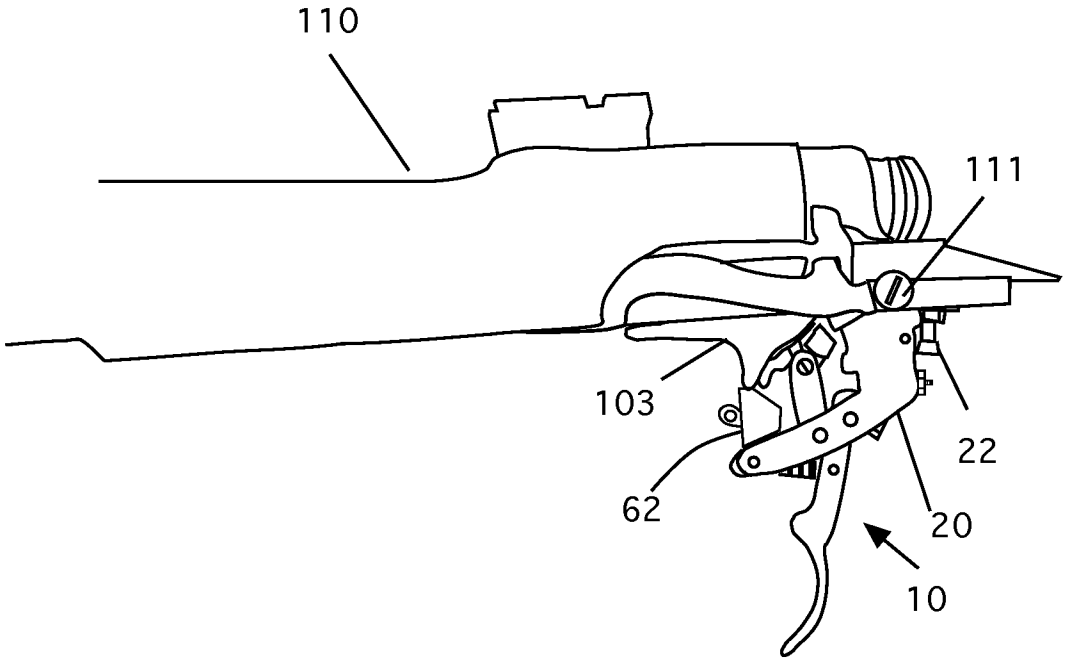
FIG. 9 is a detail view of the invention in the uncocked position mounted in a rifle with the stock removed.

FIG. 9 is a detail view of the invention in the uncocked position mounted in a rifle with the stock removed and the safety "off". All of the components are shown as before, including the blocking element 62, the setscrew 58, and the lock nut 59. Note how the bearing 53 on the trip has rotated back, allowing the sear block to fall just enough to release the firing pin (not shown).

Figure 10:
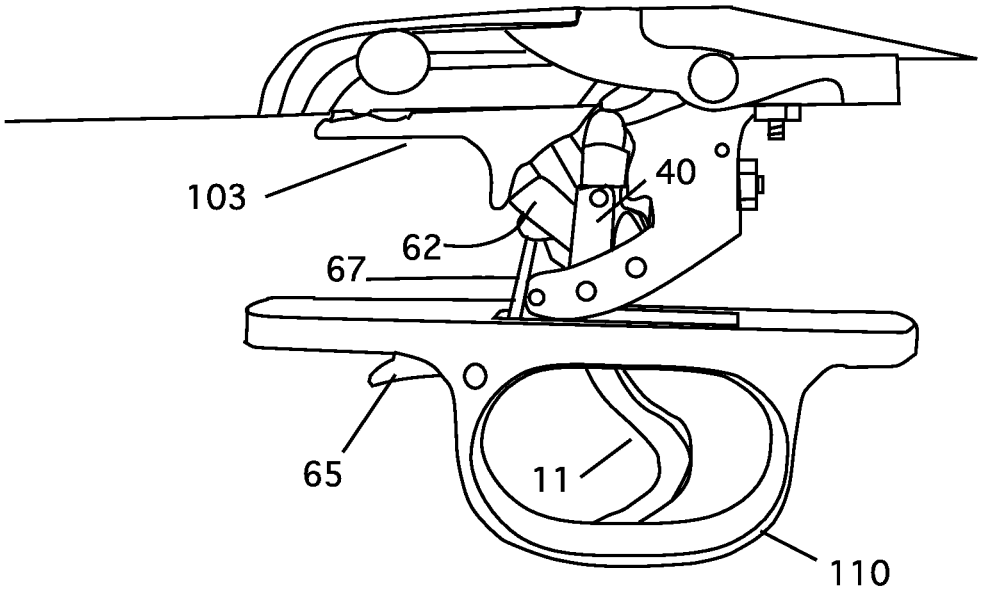

FIG. 10 is a detail view of the action, as mounted in a gun showing the trigger guard 110 and the safety mechanism. In this view, the gun is cocked and the safety is on. Note that the trigger 11 passes through a slot in the trigger guard 110 as shown. The safety is actuated by a switch 65, which is secured by pin 68 that allows the switch to rotate about the pin. The switch 65 is attached to a link 67 that attaches to the blocking element 62. With the switch in the on position, the switch is pushed up as shown. This causes the link 67 to rise vertically and to push the blocking element 62 up between the sear and the toggle 40. As noted above, when the blocking element 62 is in this position, the trigger cannot be pulled and the gun cannot fire.

Figure 11:
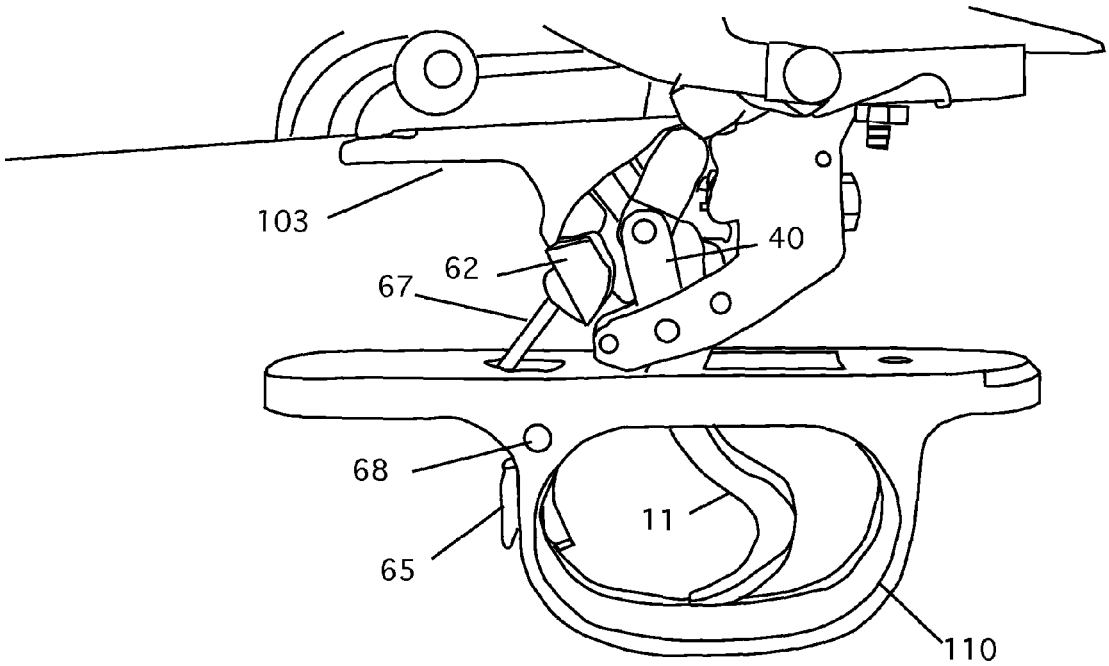
FIG. 11 is a detail view of the action, as mounted in a gun showing the trigger guard and the safety mechanism. In this view, the gun has been fired and the safety is off.

FIG. 11 is a detail view of the action, showing the gun has been fired and the safety is off. Here, the switch 65 is rotated downward to the position shown, the support 67 is slid forward and down, the blocking element 62 has moved down and the toggle 40 has pivoted forward, resulting in the gun being fired with minimal movement.

Figure 12:
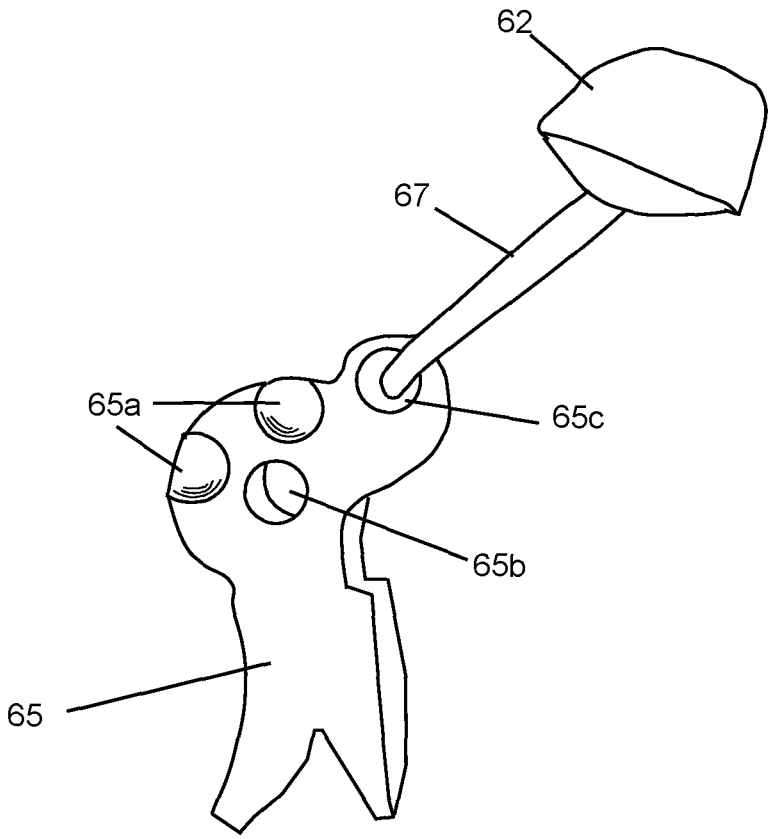
FIG. 12 is a detail view of the assembled safety mechanism removed from the gun action.

FIG. 12 is a detail view of the assembled safety mechanism removed from the gun action. In this figure, the switch 65 the link 67 and the blocking element 62 are shown. The switch 65 is shown having an upper portion that has a pair of detents 65*a* that hold the switch 65 in either the on or off position. A hole 65*b* is formed in the center to pin the switch in the action at pin 68 (see, e.g., FIG. 10). A hole 65*c* is used to secure the link 67 to the switch 65. As shown, the link 67 is a U clip that passes through the hole 65*c* and is secured onto the blocking element 62 that has two holes (not shown) to receive the link. The link 67 is then soft soldered to the blocking element 62 for use.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A soft pull trigger mechanism for use with rifles having a sear comprising:

a) a trigger pivotably attached to an encasement, said encasement having an upper portion;

b) a tripper pivotably attached to the encasement, positioned forward of said trigger and in operable communication with said trigger;

c) a trip, having a lower frame that is pivotably attached to said tripper;

d) a top bearing, pivotably attached to said lower frame of said trip and being positioned such that said top bearing is in operable communication with said sear; and e) a trip spring, having two ends, installed in said encasement, and further wherein one of said two ends of said trip spring is attached to a pin installed in said encasement and the other of said two ends is attached to said tripper f) whereby when said trigger is pulled, said trigger causes said tripper to rotate forward, causing said lower frame and top bearing to rotate rearwardly until said top bearing slides off said sear.

2. The soft pull trigger mechanism of claim 1 further comprising a down pressure adjustment mechanism.

3. The soft pull trigger mechanism of claim 2 wherein said down pressure adjustment mechanism comprises a screw and nut combination that is in operative contact with the upper portion of said encasement.

4. The soft pull trigger mechanism of claim 1 further comprising a trigger return spring, having two ends, installed in said encasement, and further wherein one of said two ends of said trip spring is attached to a pin installed in said encasement and the other of said two ends is attached to said trigger.

5. The soft pull trigger mechanism of claim 1 further comprising a trigger free play adjustment mechanism installed in said encasement, said trigger free play adjustment mechanism being in contact with said tripper to provide forward pressure on said tripper.

6. The soft pull trigger mechanism of claim 5 wherein the trigger free play adjustment mechanism includes a pin installed in a channel formed in said encasement, a setscrew positioned in said channel and abutting said pin, said setscrew having a threaded portion extending rearward from said channel, and a nut, positioned on said threaded portion of said setscrew and positioned to abut the encasement, such that as said nut is tightened on said setscrew, said pin is pushed forward against said tripper.

7. The soft pull trigger mechanism of claim 1 further comprising a trigger guard suspended below said encasement such that said trigger guard partially surrounds said trigger.

8. The soft pull trigger mechanism of claim 7 further comprising a safety mechanism installed in said encasement and said trigger guard.

9. The soft pull trigger mechanism of claim 8 wherein said safety mechanism has an on position and an off position.

10. The soft pull trigger mechanism of claim 9 wherein said safety mechanism comprises:

a) a switch, pivotably attached to said trigger guard such that said switch has an on position and an off position;

b) a link, having a top end and a bottom end, wherein said bottom end is attached to said switch said link extends upward therefrom; and c) a blocking element attached to said top end of said link and extending upwardly therefrom.

11. The soft pull trigger mechanism of claim 10 wherein when said switch is in said on position, said switch is rotated upwardly, said link is in a substantially vertical position and said blocking element is positioned between said sear and said tripper such that said tripper cannot move forward; and when said switch is in said off position, said switch is rotated downwardly, said link is in a substantially 45 degree angle with respect to a vertical plane, and said blocking element is positioned below said sear and said tripper such that said tripper can move forward freely.

* * * * *